US008754821B2

(12) United States Patent
Wang et al.

(10) Patent No.: US 8,754,821 B2
(45) Date of Patent: Jun. 17, 2014

(54) MULTI-BAND ANTENNA

(75) Inventors: Ying-Chih Wang, Tao Yuan Hsien (TW); Ling-Chen Wei, Tainan (TW); Tsung-Ming Kuo, Tainan (TW)

(73) Assignee: Quanta Computer Inc., Tao Yuan Hsien (TW)

( * ) Notice: Subject to any disclaimer, the term of this patent is extended or adjusted under 35 U.S.C. 154(b) by 446 days.

(21) Appl. No.: 13/151,032

(22) Filed: Jun. 1, 2011

(65) Prior Publication Data

US 2012/0154230 A1 Jun. 21, 2012

(30) Foreign Application Priority Data

Dec. 20, 2010 (TW) ..... 99144735 A

(51) Int. Cl.
*H01Q 21/00* (2006.01)

(52) U.S. Cl.
USPC ..... 343/725; 343/724

(58) Field of Classification Search
USPC ..... 343/725, 724, 908, 702, 895, 828
See application file for complete search history.

(56) References Cited

U.S. PATENT DOCUMENTS

| | | | | |
|---|---|---|---|---|
| 7,760,150 | B2 * | 7/2010 | Sato | 343/724 |
| 8,441,399 | B2 | 5/2013 | Wu et al. | |
| 2007/0132641 | A1 * | 6/2007 | Korva et al. | 343/700 MS |
| 2009/0033583 | A1 * | 2/2009 | Ryou et al. | 343/895 |
| 2009/0160714 | A1 * | 6/2009 | Qi et al. | 343/702 |
| 2012/0154230 | A1 * | 6/2012 | Wang et al. | 343/725 |

FOREIGN PATENT DOCUMENTS

| | | |
|---|---|---|
| CN | 102420348 | 4/2012 |

OTHER PUBLICATIONS

Search Report issued in Chinese counterpart Application No. 2011100032916, dated Nov. 15, 2013, pp. 1-2.

* cited by examiner

*Primary Examiner* — Thien M Le
(74) *Attorney, Agent, or Firm* — Brinks Gilson & Lione

(57) ABSTRACT

A multi-band antenna includes a feed-in section, a loop conductor, a first conductor arm, a second conductor arm, and a third conductor arm. The feed-in section includes a feed-in point for feeding of signals. The loop conductor extends from the feed-in section and has a grounding point disposed adjacent to the feed-in point. The first conductor arm is configured to resonate in a first frequency band and extends from the feed-in section. The second conductor arm is configured to resonate in a second frequency band and extends from the feed-in section. The third conductor arm is configured to resonate in a third frequency band and extends from the feed-in section. At least one of the loop conductor, the first conductor arm, the second conductor arm, and the third conductor arm is bent so as to be disposed in different planes.

11 Claims, 10 Drawing Sheets

MULTI-BAND ANTENNA

CROSS-REFERENCE TO RELATED APPLICATION

This application claims priority of Taiwanese Application No. 099144735, filed on Dec. 20, 2010.

BACKGROUND OF THE INVENTION

1. Field of the Invention

The present invention relates to an antenna, more particularly to a multi-band antenna for application to Wireless Local Area Network (WLAN) and World Interoperability for Microwave Access (WiMAX) communication protocols.

2. Description of the Related Art

Conventional antennas are usually not designed to be simultaneously compatible with Wireless Local Area Network (WLAN) and World Interoperability for Microwave Access (WiMAX) communication protocols. Accordingly, multiple antennas are required to be disposed in an electronic device in order to ensure compatibility of the electronic device with WLAN and WiMAX communication protocols. As a consequence, more space is required in the electronic device, thereby affecting adversely the size of the electronic device.

Some Planar Inverted-F Antennas (PIFA) are designed to employ parasitic elements for enhancing antenna coupling that is dependent upon clearances formed among radiator components and a grounding conductor so as to achieve broadband operation. However, it is difficult to control impedance frequency and bandwidth of the antenna. Moreover, efficiency of the antenna is relatively low.

SUMMARY OF THE INVENTION

Therefore, the object of the present invention is to provide a multi-band antenna that is simultaneously compatible with WLAN and WiMAX communication protocols.

Accordingly, a multi-band antenna of this invention comprises a feed-in section, a loop conductor, a first conductor arm, a second conductor arm, and a third conductor arm. The feed-in section includes a feed-in point for feeding of signals. The loop conductor extends from the feed-in section and has a grounding point disposed adjacent to the feed-in point. The first conductor arm is configured to resonate in a first frequency band and extends from the feed-in section. The second conductor arm is configured to resonate in a second frequency band and extends from of the feed-in section. The third conductor arm is configured to resonate in a third frequency band and extends from the feed-in section. At least one of the loop conductor, the first conductor arm, the second conductor arm, and the third conductor arm is bent so as to be disposed in different planes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
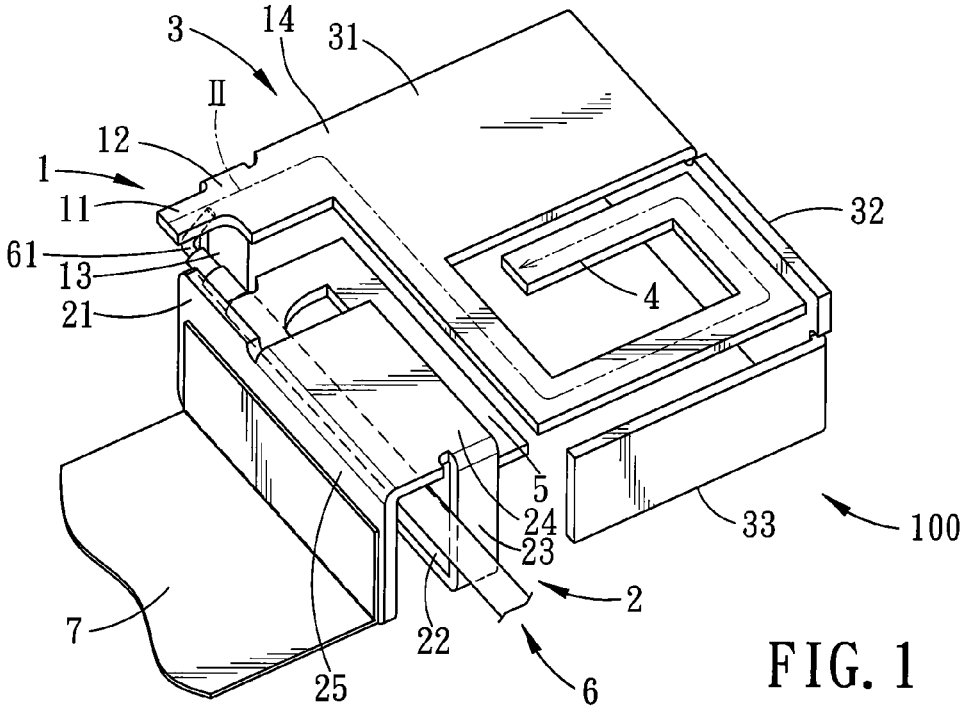
FIG. 1 is a perspective view of a preferred embodiment of a multi-band antenna according to the present invention.
Figure 2:
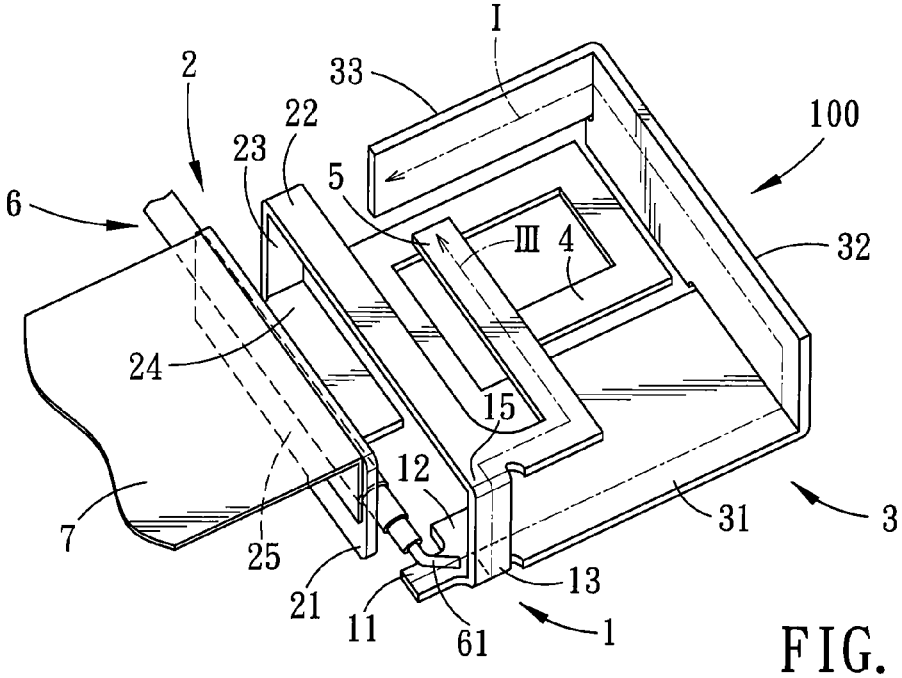
FIG. 2 is another perspective view of the preferred embodiment.
Figure 3:
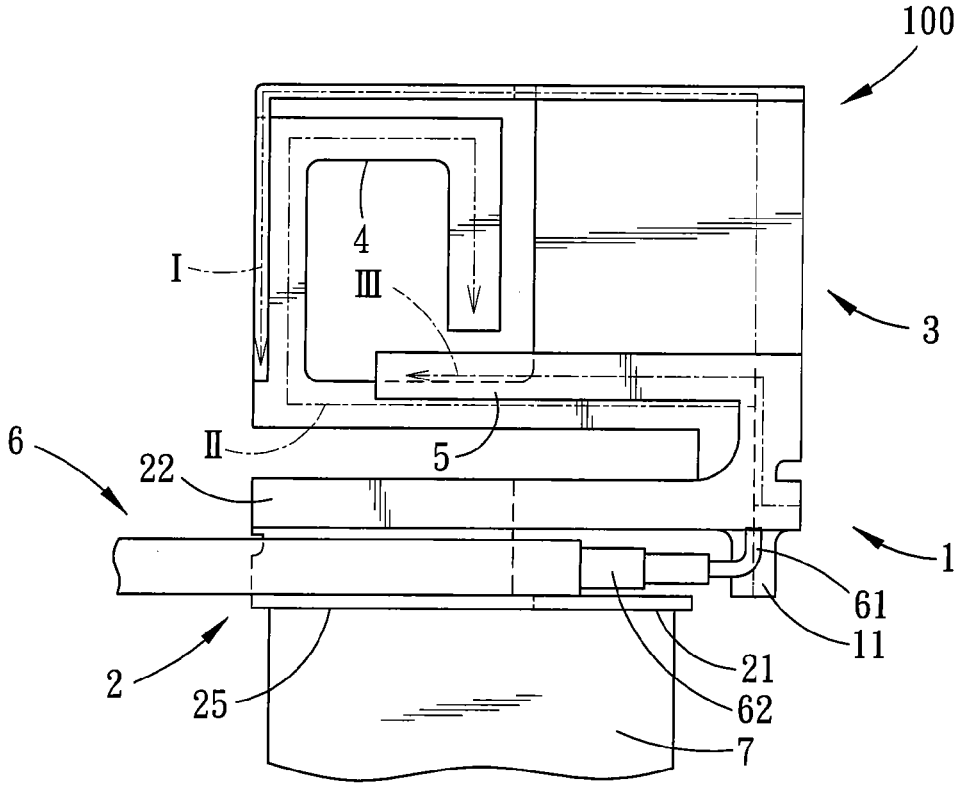
FIG. 3 is a side view of the preferred embodiment.

Referring to FIGS. 1 to 3, a preferred embodiment of the multi-band antenna 100 of the present invention includes a feed-in section 1, a loop conductor 2, a first conductor arm 3, a second conductor arm 4, a third conductor arm 5, and a coaxial cable 6.

The feed-in section 1 includes a feed-in point 11, a first conductor section 12, and a second conductor section 13. The feed-in point 11 is for feeding of signals and is electrically connected to an inner conductor 61 of the coaxial cable 6. The first conductor section 12 is connected to the first and second conductor arms 3, 4 through a first connecting segment 14 of the feed-in section 1. The feed-in point 11 is disposed on the first conductor section 12. The second conductor section 13 is connected to the first conductor section 12 and is connected to the third conductor arm 5 and the loop conductor 2 through a second connecting segment 15 of the feed-in section 1.

In this embodiment, the feed-in section 1 is bent such that the first conductor section 12 and the second conductor section 13 are disposed respectively on first and second planes that are substantially perpendicular to each other.

The loop conductor 2 extends from the second connecting segment 15 of the feed-in section 1 and has a grounding point 21 that is disposed adjacent to the feed-in point 11 and that is electrically connected to an outer conductor 62 of the coaxial cable 6. The loop conductor 2 is generally spiral-shaped, and includes a fourth radiator section 22 connected to the second conductor section 13 through the second connecting segment 15, a fifth radiator section 23 connected to one end of the fourth radiator section 22 opposite to the second conductor section 13, a sixth radiator section 24 connected to one end of the fifth radiator section 23 opposite to the fourth radiator section 22, and a seventh radiator section 25 connected to one end of the sixth radiator section 24 opposite to the fifth radiator section 23. The grounding point 21 is disposed on the seventh radiator section 25.

In this embodiment, the loop conductor 2 is bent such that the fourth, fifth, sixth, and seventh radiator sections 22, 23, 24, 25 are disposed on different planes, in which the fourth radiator section 22 is disposed on a third plane that is substantially perpendicular to the second plane and that is spaced apart from the first plane, the fifth radiator section 23 is disposed on a fourth plane that is substantially perpendicular to the first and third planes and that is spaced apart from the second plane, the sixth radiator section 24 is disposed on the first plane, and the seventh radiator section 25 is disposed on a fifth plane that is substantially perpendicular to the first, second, third, and fourth planes.

In this embodiment, a conductive cooper foil 7 is disposed to connect to the seventh radiator section 25 so as to increase a ground area of the multi-band antenna 100.

The first conductor arm 3 is configured to resonate in a first frequency band, has a substantially U-shaped profile, and extends from the first connecting segment 14 of the feed-in section 1. The first conductor arm 3 includes a first radiator section 31 connected to the first conductor section 12 through the first connecting segment 14, a second radiator section 32 connected to one end of the first radiator section 31 opposite to the first conductor section 12, and a third radiator section 33 connected to one end of the second radiator section 32 opposite to the first radiator section 31.

In this embodiment, the first conductor arm 3 is bent such that the first, second, and third radiator sections 31, 32, 33 are disposed on different planes, in which the first and third radiator sections 31, 33 are disposed respectively on the first and fourth planes and the second radiator section 32 is disposed on a sixth plane that is substantially perpendicular to the first, second, third, and fourth planes and that is spaced apart from the fifth plane.

Current in the first conductor arm 3 flows from the feed-in point 11 to the third radiator section 33 through the first and second radiator sections 31, 32 as indicated by arrow (I) in FIG. 2.

The second conductor arm 4 is configured to resonate in a second frequency band, is disposed on the first plane, and extends from the first connecting segment 14 of the feed-in section 1. The second conductor arm 4 is generally spiral-shaped, and is surrounded by the first conductor arm 3. Current in the second conductor arm 4 flows from the feed-in point 11 to the second conductor arm 4 through the first radiator section 12 as indicated by arrow (II) in FIG. 1.

The third conductor arm 5 is configured to resonate in a third frequency band, is disposed on the third plane, and extends from the second connecting segment 15 of the feed-in section 1. The third conductor arm 5 is substantially L-shaped, and is spaced apart from and substantially parallel to the first radiator section 31 of the first conductor arm 3. Current in the third conductor arm 5 flows from the feed-in point 11 to the third conductor arm 5 through the first and second conductor sections 12, 13 as indicated by arrow (III) in FIG. 3.

Figure 4:
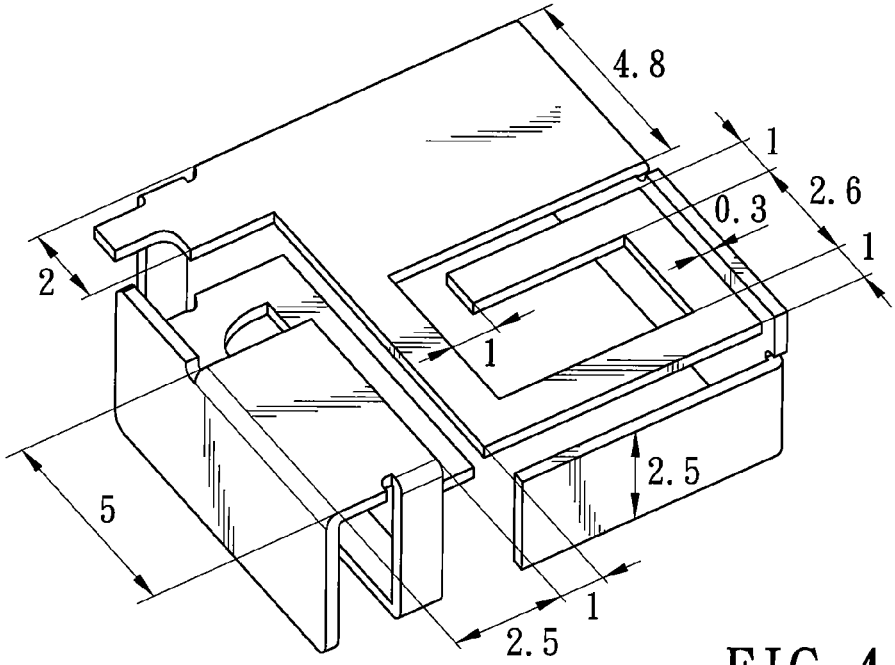
FIG. 4 is a schematic diagram illustrating dimensions of the preferred embodiment.
Figure 5:
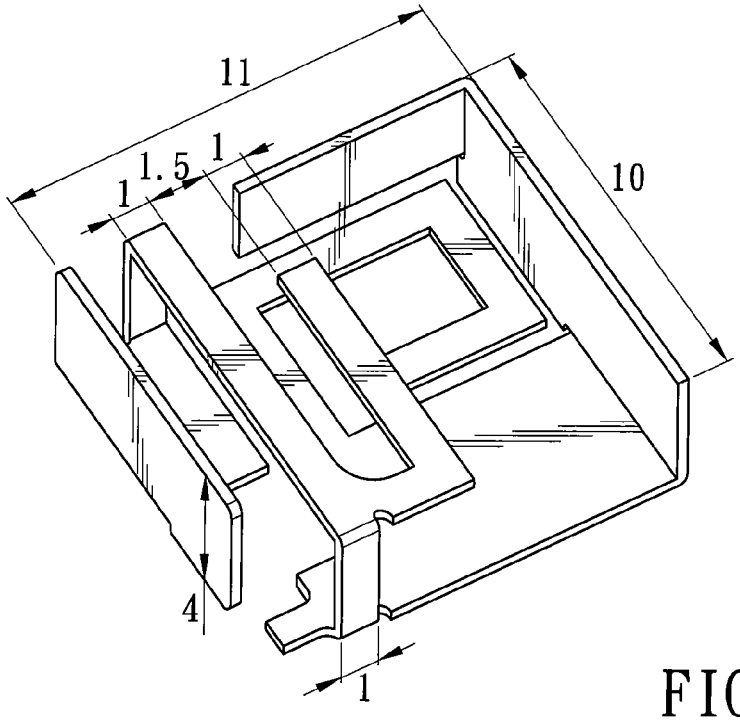
FIG. 5 is another schematic diagram illustrating dimensions of the preferred embodiment.

Referring to FIGS. 4 and 5, the detailed dimensions (in mm) of the multi-band antenna 100 of the preferred embodiment are shown. Preferably, the loop conductor 2 is in a form of a Planar Inverted-F Antenna (PIFA). Resonant paths of the first, second, and third conductor arm 3, 4, 5 are respectively one quarter-wavelength of the first, second, and third frequency bands. With the dimensions shown in FIGS. 4 and 5, the first frequency band ranges from 2.3 GHz~2.7 GHz, the second frequency band ranges from 3.3 GHz~3.8 GHz, and the third frequency band ranges from 5.15 GHz~5.85 GHz, which are compatible with WLAN and WiMAX communication protocols.

Figure 6:
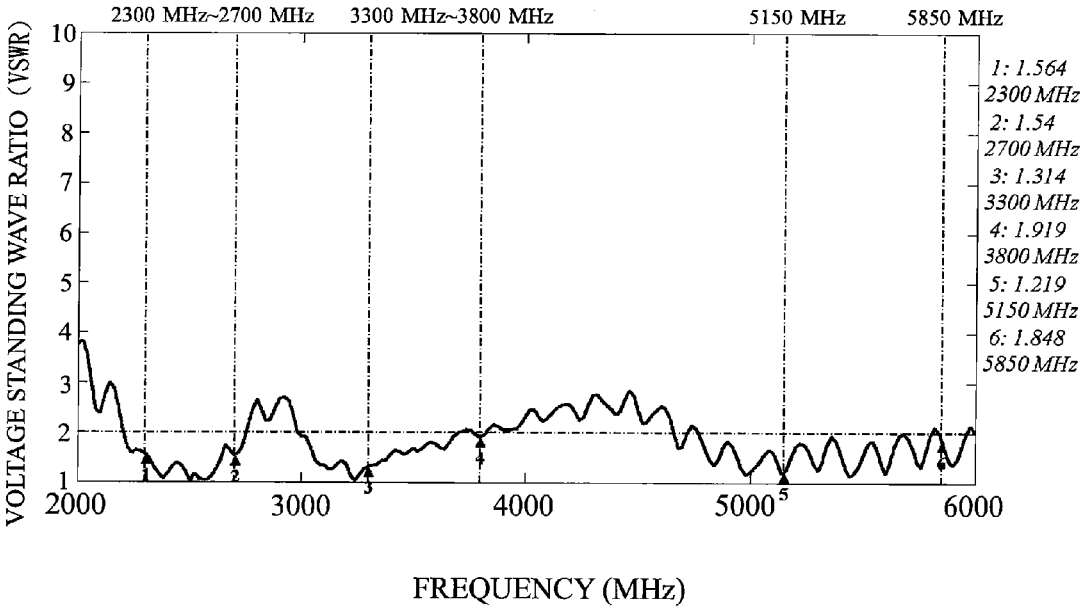
FIG. 6 is a Voltage Standing Wave Ratio (VSWR) plot showing VSWR values of the preferred embodiment.
Figure 7:
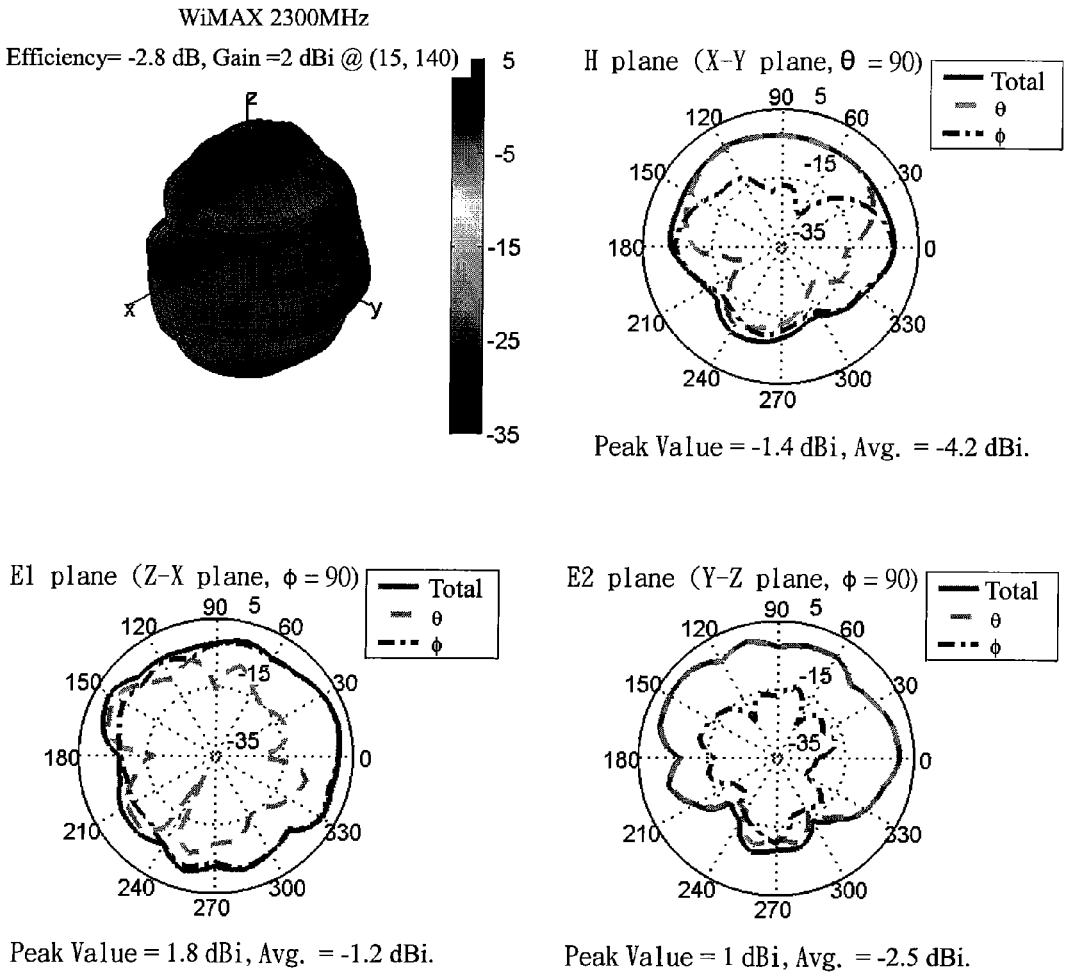
FIG. 7 illustrates radiation patterns of the preferred embodiment operating at 2300 MHz.
Figure 8:
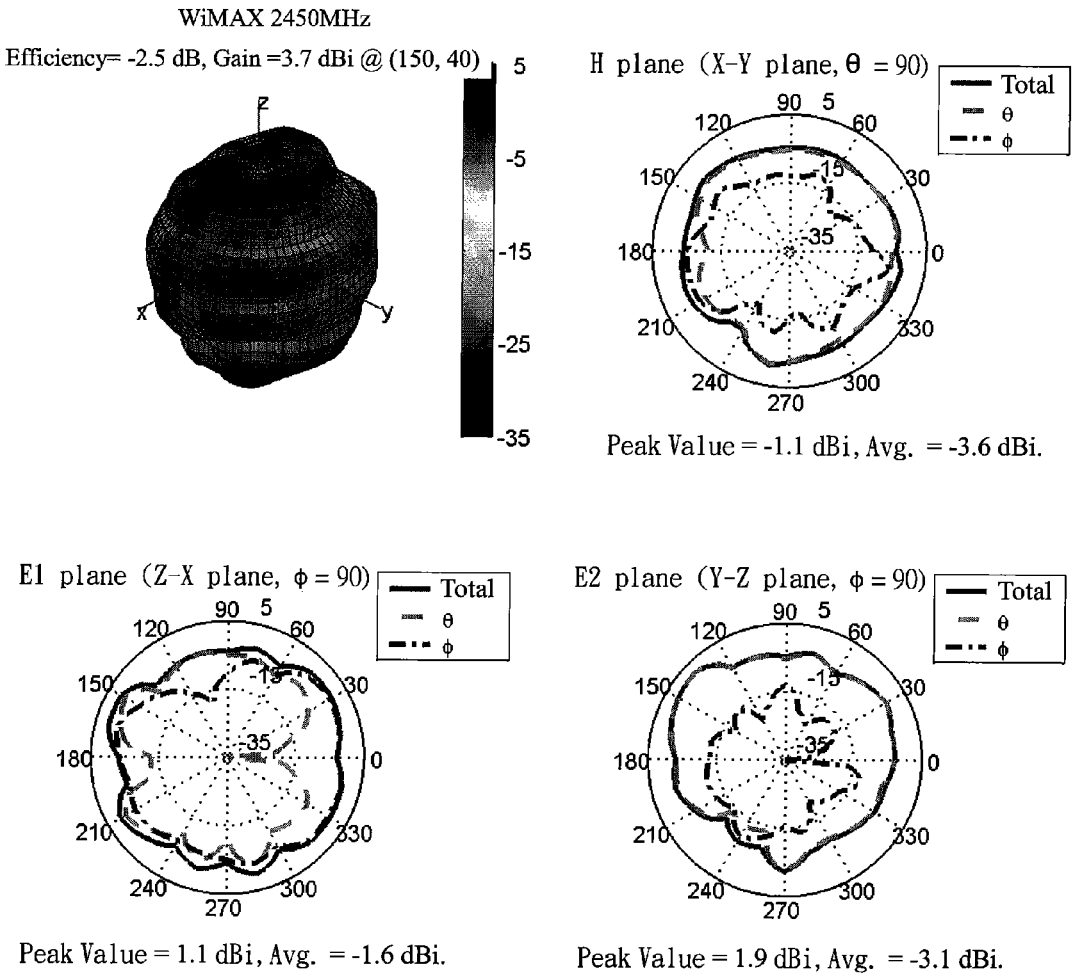
FIG. 8 illustrates radiation patterns of the preferred embodiment operating at 2450 MHz.
Figure 9:
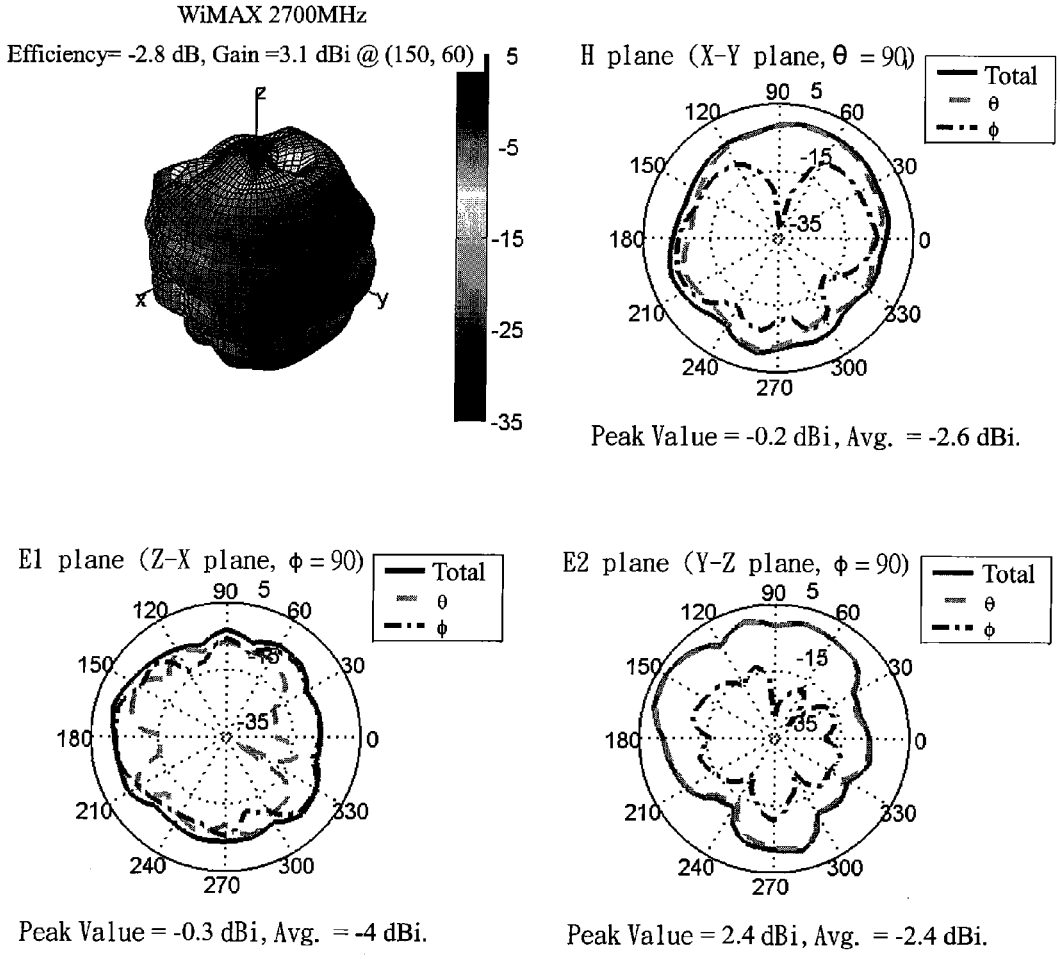
FIG. 9 illustrates radiation patterns of the preferred embodiment operating at 2700 MHz.
Figure 10:
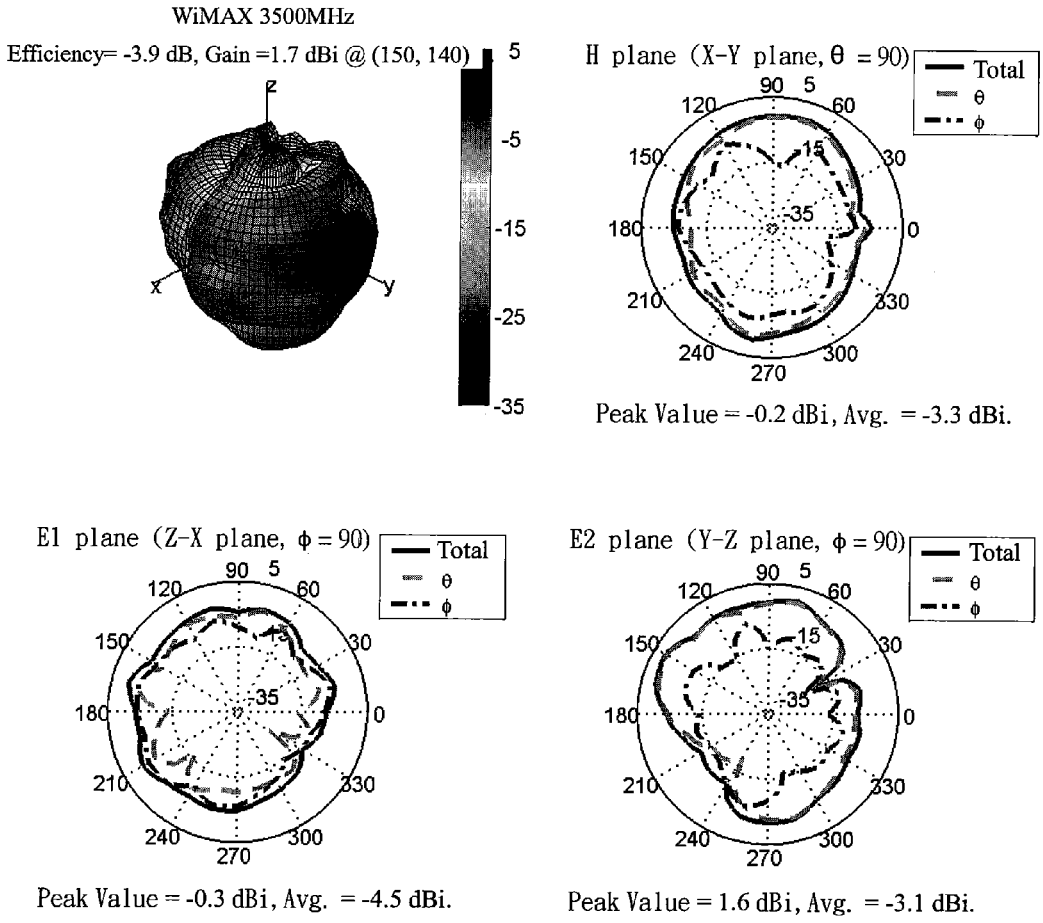
FIG. 10 illustrates radiation patterns of the preferred embodiment operating at 3500 MHz.
Figure 11:
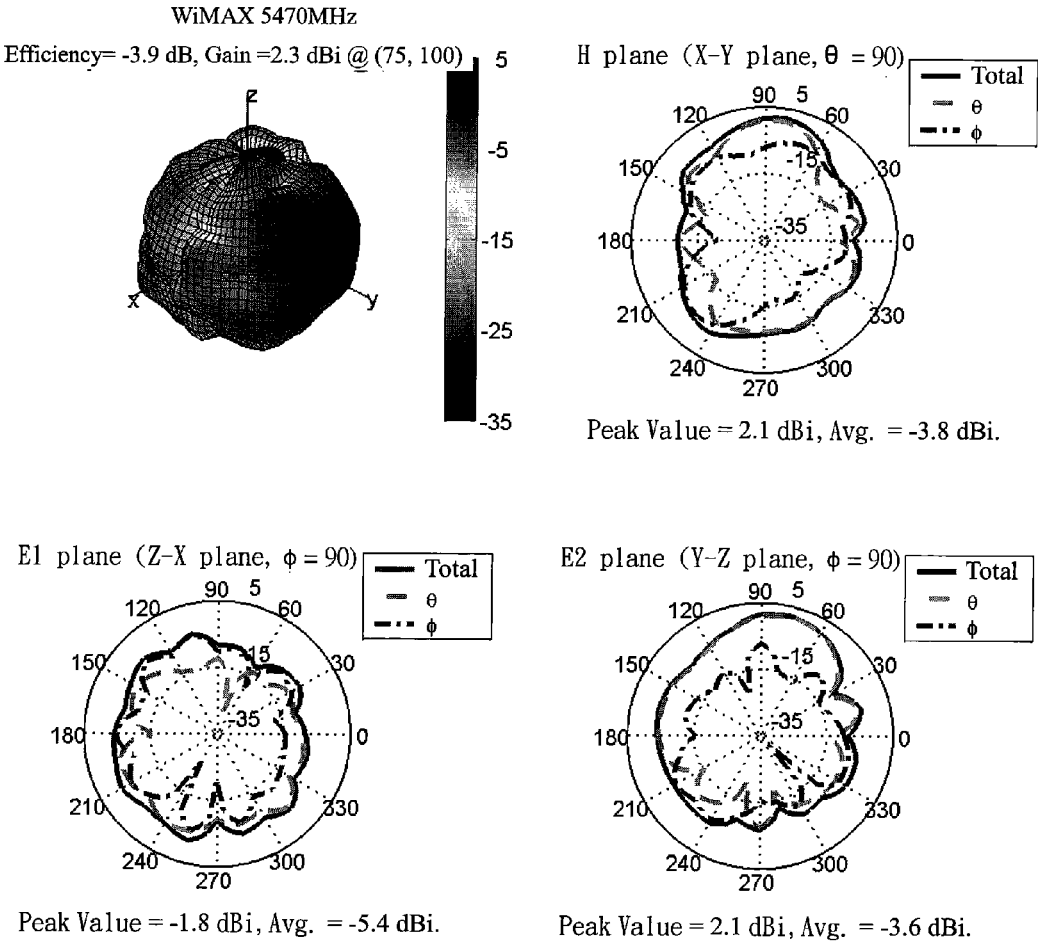
FIG. 11 illustrates radiation patterns of the preferred embodiment operating at 5470 MHz.

Referring to FIG. 6, which is a voltage standing wave ratio (VSWR) plot of this embodiment, the VSWR values of the multi-band antenna 100 of this embodiment at the first, second, and third frequency bands are smaller than 2:1. According to Table 1 below, the radiation efficiency of the multi-band antenna 100 is greater than 35% at frequencies within the first, second, and third frequency bands.

TABLE 1

| Frequency (MHz) | Efficiency (dB) | Efficiency (%) |
|---|---|---|
| 2300 | −2.79 | 52.57 |
| 2350 | −3.41 | 45.58 |
| 2400 | −2.30 | 58.82 |
| 2450 | −2.45 | 56.88 |
| 2500 | −3.05 | 49.60 |
| 2550 | −2.82 | 52.23 |
| 2600 | −2.68 | 53.98 |
| 2650 | −3.21 | 47.81 |
| 2700 | −2.76 | 53.01 |
| 3300 | −3.22 | 47.70 |
| 3400 | −2.94 | 50.78 |
| 3500 | −3.89 | 40.86 |
| 3600 | −4.19 | 38.08 |
| 3700 | −2.94 | 50.86 |
| 3800 | −3.26 | 47.24 |
| 5150 | −3.16 | 48.29 |
| 5250 | −3.63 | 43.33 |
| 5350 | −3.56 | 44.04 |
| 5470 | −3.89 | 40.86 |
| 5600 | −3.23 | 47.52 |
| 5725 | −3.86 | 41.11 |
| 5785 | −3.84 | 41.35 |
| 5850 | −3.94 | 40.40 |

FIGS. 7 to 11 illustrate radiation patterns of the multi-band antenna 100 of this embodiment. It is evident from these figures that the radiation patterns of the multi-band antenna 100 in the abovementioned first, second, and third frequency bands have relatively good omni-directionality.

Figure 12:
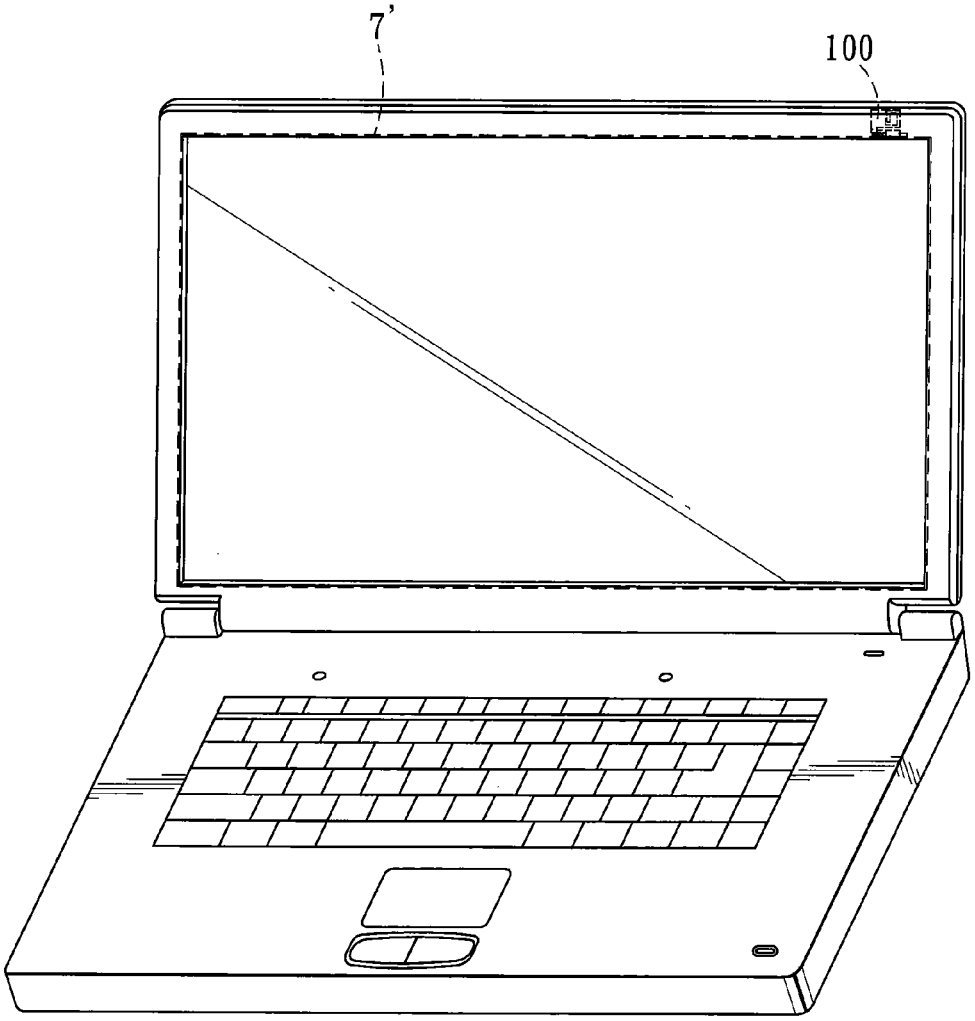
FIG. 12 is a perspective view of a notebook computer provided with the preferred embodiment.

Referring to FIG. 12, the multi-band antenna 100 of this embodiment is disposed at an edge above a panel device of a notebook computer. A conductive cooper foil 7' is disposed to connect to the multi-band antenna 100 so as to increase a ground area.

To sum up, the first conductor arm 3, the second conductor arm 4, and the third conductor arm 5 resonate respectively in the first frequency band (2.3 GHz~2.7 GHz), the second frequency band (3.3 GHz~3.8 GHz), and the third frequency band (5.15 GHz~5.85 GHz). Therefore, the multi-band antenna 100 of this invention is simultaneously compatible with WLAN and WiMAX communication protocols, occupies a relatively small area, and is suitable for application to thin electronic devices.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna comprising:

a feed-in section including a feed-in point for feeding of signals;

a loop conductor extending from said feed-in section and having a grounding point disposed adjacent to said feed-in point;

a first conductor arm configured to resonate in a first frequency band and extending from said feed-in section;

a second conductor arm configured to resonate in a second frequency band and extending from said feed-in section; and a third conductor arm configured to resonate in a third frequency band and extending from said feed-in section;

wherein:

at least one of said loop conductor, said first conductor arm, said second conductor arm, and said third conductor arm is bent so as to be disposed in different planes; and said first conductor arm has a substantially U-shaped profile, and includes a first radiator section connected to said feed-in section, a second radiator section connected to one end of said first radiator section opposite to said feed-in section, and a third radiator section connected to said second radiator section, said first, second, and third radiator sections being disposed on different planes.

2. The multi-band antenna as claimed in claim 1, wherein said second conductor arm is generally spiral-shaped and is surrounded by said first conductor arm, said second conductor arm and said first radiator section of said first conductor arm being disposed on a same plane.

3. The multi-band antenna as claimed in claim 2, wherein said third conductor arm is substantially L-shaped, and is spaced apart from and substantially parallel to said first radiator section of said first conductor arm.

4. The multi-band antenna as claimed in claim 3, wherein said loop conductor includes a fourth radiator section connected to said feed-in section, a fifth radiator section connected to one end of said fourth radiator section opposite to said feed-in section, a sixth radiator section connected to said fifth radiator section, and a seventh radiator section connected to said sixth radiator section and on which said grounding point is disposed, said fourth, fifth, and sixth radiator sections being disposed on different planes.

5. The multi-band antenna as claimed in claim 4, wherein said feed-in section includes a first connecting segment, a second connecting segment, a first conductor section connected to said first and second conductor arms through said first connecting segment and on which said feed-in point is disposed, and a second conductor section connected to said first conductor section and connected to said third conductor arm and said loop conductor through said second connecting segment.

6. The multi-band antenna as claimed in claim 5, wherein said first conductor section, said first radiator section, said second conductor arm, and said sixth radiator section are disposed on a first plane.

7. The multi-band antenna as claimed in claim 6, wherein said second conductor section is disposed on a second plane that is substantially perpendicular to the first plane.

8. The multi-band antenna as claimed in claim 7, wherein said third conductor arm and said fourth radiator section are disposed on a third plane that is substantially perpendicular to said second plane and that is spaced apart from the first plane.

9. The multi-band antenna as claimed in claim 8, wherein said third radiator section is disposed on a fourth plane that is substantially perpendicular to the first and third planes and that is spaced apart from the second plane.

10. The multi-band antenna as claimed in claim 9, wherein said seventh radiator section is disposed on a fifth plane that is substantially perpendicular to the first, second, third, and fourth planes.

11. The multi-band antenna as claimed in claim 10, wherein said second radiator section is disposed on a sixth plane that is substantially perpendicular to the first, second, third, and fourth planes and that is spaced apart from the fifth plane.

* * * * *